United States Patent [19]

George et al.

[11] 4,272,594

[45] Jun. 9, 1981

[54] PHOTOGRAPHIC PRODUCT INCLUDING A LIGHT-REFLECTING LAYER WITH CARBON COATED WITH REFLECTING MATERIAL

[75] Inventors: Louis J. George, Somerville; Barbara A. Theobald, Boston, both of Mass.

[73] Assignee: Polaroid Corporation, Cambridge, Mass.

[21] Appl. No.: 966,088

[22] Filed: Dec. 4, 1978

[51] Int. Cl.[3] ..... G03C 1/40; G03C 1/84; G03C 5/54; G03C 1/48

[52] U.S. Cl. ..... 430/14; 430/220; 430/227; 430/510

[58] Field of Search ..... 96/76 R, 76 C, 77, 84 R, 96/119 R; 430/220, 227, 510, 14

[56] References Cited

U.S. PATENT DOCUMENTS

| | | | |
|---|---|---|---|
| 3,415,644 | 12/1968 | Land | 96/77 |
| 3,635,707 | 1/1972 | Cole | 96/77 |
| 3,647,435 | 3/1972 | Land | 96/77 |
| 3,647,437 | 3/1972 | Land | 96/77 |

*Primary Examiner*—Richard L. Schilling
*Attorney, Agent, or Firm*—Louis G. Xiarhos

[57] ABSTRACT

Photographic diffusion transfer products of the integral negative-positive type adapted to the provision of a diffusion transfer image retained within a permanent laminate having at least one developed silver halide emulsion, and viewable through a transparent support against a reflecting background, are described. A light-reflecting layer, comprising a polymeric binder matrix, a light-reflecting pigment and a light-absorbing particulate carbon-based pigment material, is employed in such products for the provision of opacification to permit in-light development and for the provision of a layer against which the diffusion transfer image may be viewed.

40 Claims, 2 Drawing Figures

PHOTOGRAPHIC PRODUCT INCLUDING A LIGHT-REFLECTING LAYER WITH CARBON COATED WITH REFLECTING MATERIAL

BACKGROUND OF THE INVENTION

This invention relates to photographic products and processes for the formation of images in color or black-and-white by diffusion transfer processing. More particularly, it relates to photographic products adapted to the provision of a diffusion transfer image retained within a permanent laminate having at least one developed silver halide emulsion and viewable through a transparent support against a reflecting background.

Diffusion transfer photographic products and processes have been described in the art and details relating to such products and processes can be found, for example, in U.S. Pat. Nos. 2,983,606; 3,415,644; 3,415,645; 3,415,646; 3,473,925; 3,482,972; 3,551,406; 3,573,042; 3,573,043; 3,573,044; 3,576,625; 3,576,626; 3,578,540; 3,579,333; 3,594,164; 3,594,165; 3,597,200; 3,647,437; 3,672,486; 3,672,890; 3,705,184; 3,752,836; 3,857,865; and in British Pat. No. 1,330,524.

Essentially, diffusion transfer photographic products and processes involve film units having a photosensitive system including at least one silver halide layer usually integrated with an image-providing material. After photoexposure, the photosensitive system is developed to establish an imagewise distribution of a diffusible image-providing material, at least a portion of which is transferred by diffusion to an image-receiving layer capable of mordanting or otherwise fixing the transferred image-providing material. In some diffusion transfer products, the transfer image is viewed by reflection after separation of the image-receiving element from the photosensitive system. In other products, however, such separation is not required and the transfer image is viewed against a reflecting background, usually provided by a dispersion of a white, light-reflecting pigment such as titanium dioxide.

A number of photographic products and processes have been proposed for providing photographs comprising the developed silver halide emulsion(s) retained as part of a permanent laminate, with the desired image being viewed through a transparent support against a reflecting background. In such photographs, the image-carrying layer is separated from the developed silver halide emulsion(s) in the laminate by a light-reflecting layer, e.g., a layer containing titanium dioxide, positioned between the image-carrying layer and the developed silver halide emulsion(s). Diffusion transfer photographic products providing an image viewable without separation against a reflecting background in such a laminate have been referred to in the art as "integral negative-positive film units" and such units have been of two general types.

Integral negative-positive film units of a first type are described, for example, in the above-noted U.S. Pat. No. 3,415,644 and include appropriate photosensitive layer(s) and image dye-providing materials carried on an opaque support, an image-receiving layer carried on a transparent support and means for distributing a processing composition between the elements of the film unit. Photoexposure is made through the transparent support and image-receiving layer and a processing composition which includes a reflecting pigment is distributed between the image-receiving and photosensitive components. After distribution of the processing composition and before processing is complete, the film unit can be, and usually is, transported into light. Accordingly, in integral negative-positive film units of this type, the layer provided by distributing the reflecting pigment must be capable of performing specific and critical assigned functions. Until processing is complete, the distributed reflecting layer must be able to provide at least partial protection against further exposure of the photoexposed element. At the same time, however, the layer must be sufficiently permeable to permit effective transfer of image-forming materials from the photoexposed photosensitive layer(s) to the image-receiving layer. Moreover, after transfer, the layer must provide a reflecting background of suitable efficiency for viewing the image transferred to the image-receiving layer. Also, in film units of this type, the reflecting layer masks the developed photosensitive layer(s).

Integral negative-positive film units of a second type, as described, for example, in U.S. Pat. No. 3,594,165, include a transparent support, carrying the appropriate photosensitive layers and associated image dye-providing materials, a permeable opaque layer, a permeable light-reflecting pigment-containing layer, an image-receiving layer viewable through a transparent support against the light-reflecting layer, and means for distributing a processing composition between the photosensitive layer and a transparent cover or spreader sheet. Additionally, integral negative-positive film units of this second type include an opaque processing composition which is distributed after photoexposure to provide a second opaque layer which can prevent additional exposure of the photosensitive element. In film units of this second type, exposure is made through the transparent cover sheet. After distribution of the processing composition and installation of the second opaque layer, this type of film unit can also be transported into light before processing is complete. Accordingly, in film units of this second type, the light-reflecting pigment-containing layer may also perform the critical assigned functions of providing at least partial protection for the photoexposed element until processing is complete, but again, this layer must permit effective transfer of image-forming material to the image-receiving layer. Also, like the film units of the "first type", the layer must provide a suitable reflecting background for viewing the dye image transferred to the image-receiving layer. Moreover, effective masking of the developed photosensitive layer(s) must also be achieved for film units of this "second type".

In many known integral negative-positive film units, auxiliary opacification systems have been used in combination with light-reflecting layers and light-reflecting layer materials. These auxiliary opacification systems are designed to cooperate with the reflecting layer and/or reflecting layer materials to provide sufficient opacity to prevent further exposure of the film unit through the reflecting layer during processing of the film unit in light.

U.S. Pat. No. 3,647,437, for example, describes an auxiliary opacification system that has been extensively in commercial integral negative-positive film units of the first type, e.g., film units of the type described in U.S. Pat. No. 3,415,644. That auxiliary opacification system essentially involves a pH-sensitive, optical filter agent which can absorb light at one pH but is rendered less light-absorbing at another pH. As disclosed in U.S. Pat. No. 3,647,437, the optical filter agent is usually dispersed in the film unit's processing composition together with a light-reflecting pigment. In turn, the processing composition is integrated with elements of the film unit so that the composition can be distributed between the photoexposed photosensitive layer(s) and the image-receiving layer. Accordingly, after distribution of the processing composition, an opaque layer comprising the reflecting pigment and the optical filter agent is provided and the opaque layer covers a major surface of the photoexposed layer(s). At least during the initial stages of development, the pH sensitive optical filter agent absorbs light and cooperates with the reflecting pigment to provide a degree of opacity sufficient to prevent photoexposure through the layer. As transfer of image-forming material proceeds, the light-absorbing capability of the pH-sensitive optical filter agent is reduced until the agent becomes substantially non-light absorbing and its opacification function is terminated. When transfer of image-forming material is complete, the reflecting layer comprising the reflecting pigment and the non-light absorbing filter agent, provides a reflecting background for viewing the dye image.

While the utilization of pH-sensitive optical filter agents in integral negative-positive film units as described is effective to provide the requisite opacification to permit in-light development of photoexposed silver halide emulsions in such laminate structures, there are certain notable disadvantages associated with such utilization. For example, such pH-sensitive optical filter agents tend to be large molecular species and may inhibit the rate of diffusion therethrough of image-forming materials, e.g., image-forming dyes. In addition, such pH-sensitive optical filter agents are highly colored in their light-absorbing or opacifying mode and, thus, image formation will be observed to occur against such colored background. It may be preferred to some consumers that the image formation appear to emerge from a white or nearly white background and the utilization of a reflecting layer providing such a white background in a photographic laminate may be preferred to such consumers.

In addition to pH-sensitive optical filter agents, carbon has also been used as an auxiliary opacification agent for integral negative-positive film units. For example, dispersions of reflecting pigments and small amounts of carbon, about 1 part of carbon to about 100 to 500 parts of reflecting pigment, have been proposed to provide light-reflecting layers for film units of the type described in U.S. Pat. No. 3,415,644. Similarly, carbon has been employed as an auxiliary opacification agent in integral negative-positive film units of the type described in the aforesaid U.S. Pat. No. 3,549,165. Film units of this type have a permeable reflecting layer as an integral layer of the film unit and a layer of light-absorbing pigment, usually carbon, positioned between the light-reflecting layer and the photosensitive element to provide additional opacification for protection of the photosensitive element during processing and for effective masking of the photoexposed and developed element.

U.S. Pat. No. 3,647,435 describes still another integral negative-positive film unit which uses carbon as an auxiliary opacification agent. In the film units described in such patent, a reflecting layer is generated in situ from a preformed layer of reflecting pigment precursor, the processing composition containing dispersed carbon. After dye transfer is complete, the generated light-reflecting pigment layer provides a reflecting background for viewing the dye image and masks the distributed carbon.

The utilization of dispersed carbon in a processing composition or a preformed layer of carbon in an integral negative-positive film unit, while effective to provide efficient opacification, may detract from the ability to provide a white reflecting background for viewing of the desired photographic image. Additionally, the utilization of a preformed carbon layer requires that such layer be integrated into a diffusion transfer unit containing a plurality of other sheet or coated elements required or customarily utilized in the manufacture of such film units.

It is an object of the present invention to provide photographic diffusion transfer products and processes effective for the provision of a diffusion transfer image as part of a permanent laminate and viewable through a transparent element against a light-reflecting layer.

It is another object of the present invention to provide a light-reflecting layer in such products and processes effective to provide the requisite opacification to permit in-light development of the photoexposed silver halide emulsion(s) thereof while providing light-reflecting properties suitable for viewing of the desired transfer image.

Yet another object of the present invention is to provide a light-reflecting layer useful for the provision of opacification and light-reflecting properties without the required employment of additional opacification agents or systems.

Still another object of the present invention is to provide photographic diffusion transfer products and processes of the integral negative-positive type effective for the provision, in a unitary and readily integrated light-reflecting layer, of opacification sufficient to permit in-light development and light-reflecting properties sufficient for background viewing of a desired transfer image.

Other objects will become apparent from the description appearing hereinafter.

SUMMARY OF THE INVENTION

These and other objects can be achieved by the present invention which resides in photographic diffusion transfer products and processes adapted to provide a particular light-reflecting layer positioned between the silver halide emulsion(s) and the image-receiving layer of a photographic laminate. The present invention is based in part upon the discovery that a light-reflecting layer, comprising a suitable polymeric binder matrix having uniformly distributed therethrough a light-reflecting pigment in combination with a light-absorbing particulate carbon-based pigment material, can be suitably employed in diffusion transfer integral negative-positive film units for the provision of opacification sufficient to permit in-light development and that the reflecting layer provides white light-reflecting properties for the viewing against such layer of the diffusion transfer image. It has been found that a unitary light-reflecting layer comprising a suitable polymeric binder matrix, a first light-reflecting pigment material and a second light-absorbing carbon-based pigment comprising particulate carbon having a light-reflecting material associated with at least a portion of the surface area of the carbon can be readily integrated into a diffusion transfer integral-negative film unit and that sufficient opacification to permit in-light development of the film unit can be realized without the required employment of addition opacification agents or systems, and while still providing, a white or substantially white background for the viewing of the diffusion transfer image.

Essentially, the reflecting layers presented by way of the present invention comprise a suitable polymeric binder matrix having uniformly distributed therethrough a mixture or blend of at least two different pigments. The first pigment is a highly efficient light-reflecting pigment such as titanium dioxide and constitutes the major ingredient of the pigment mixture. The second pigment material is a particulate light-absorbing carbon-based pigment having the light-absorbing property of carbon as well as a degree of light-reflecting characteristics. As is known in the art, carbon pigments are highly efficient, light-absorbing pigments. The carbon pigment employed in this invention, however, is modified or altered to provide a carbon pigment having reduced or adjusted light-absorbing characteristics. The alteration or modification of the normally light-absorbing carbon pigment is preferably achieved by associating light-reflecting compounds with at least a portion of the carbon pigment particle to reduce the light-absorbing characteristics of the carbon pigment. Also, by associating a light-reflecting compound with the carbon pigment, the pigment exhibits a degree of light reflectivity; but, that degree of light reflectivity is lower than that of the first light-reflecting pigment which, as mentioned, is the major ingredient of the pigment mixture used to form the light-reflecting layer.

In one of its product aspects, the present invention provides a photographic product for forming a diffusion transfer image within a permanent laminate which includes at least one developed silver halide layer. Such a product comprises, in combination, an image-receiving layer; at least one photosensitive silver halide emulsion layer, each said silver halide emulsion having associated therewith an image-forming material; means for providing a light-reflecting layer of the invention, as hereinbefore described, positioned between the image-receiving layer and silver halide layer or layers and effective to mask the developed silver halide layer or layers and to provide a white background for viewing a transfer image in the image-receiving layer; a transparent support through which the transfer image may be viewed against the light-reflecting layer; and means for providing a processing composition for developing the silver halide emulsion or emulsions after photoexposure and for forming a transfer image in said image-receiving layer.

In another of its product aspects, the present invention provides a photographic laminate, also termed an integral negative-positive reflection print. Such product comprises, permanently laminated together: at least one exposed and developed silver halide layer; an image-carrying layer containing a diffusion transfer image; a light-reflecting layer of the invention as hereinbefore described, positioned between the silver halide layer or layers and the image-receiving layer and effective to mask the developed silver halide layer or layers and provide a white background for viewing the transfer image in the image-receiving layer; and a transparent layer through which the image may be viewed against the light-reflecting layer.

Various objects, details, constructions, operations, uses, advantages and modifications of the invention will be apparent from the following description, taken in conjunction with the illustrative drawing of certain embodiments thereof.

DETAILED DESCRIPTION OF THE INVENTION

As noted above, this invention is particularly concerned with color diffusion transfer processes wherein the layer containing the diffusion transfer image, i.e., the image-receiving layer, is not separated from the developed photosensitive layers after processing but both components are retained together as part of a permanent laminate. Film units particularly adapted to provide such diffusion transfer image, as noted above, are frequently referred to as "integral negative-positive" film units. The resulting image may be referred to as an "integral negative-positive reflection print", and as so used, this expression is intended to refer to a reflection print wherein the developed photosensitive layers have not been separated from the image layer, i.e., the layer containing the transfer dye image. A light-reflecting layer of the invention, positioned between the developed photosensitive layer(s) and the image layer, provides a white background for the dye image and masks the developed photosensitive layer(s). These layers are part of a permanent laminate which usually includes dimensionally stable outer or support layers, the transfer dye image being viewable through one of said supports. This invention is particularly concerned with providing film units of the integral negative-positive type with opacification properties for in-light development while providing a suitable background for viewing of the resulting integral negative-positive reflection prints. With reference to such background, the term white is used herein and refers to a background which may be regarded white, near white or substantially white and which is sufficiently light-reflecting to provide an aesthetically pleasing background for the viewing of a desired image.

The present invention is applicable to a variety of diffusion transfer processes. The arrangement and order of the individual layers of the film used in such processes may vary in many ways as is known in the art, provided the final photograph is a laminate wherein the desired image is viewed through a transparent support, e.g., an integral negative-positive reflection print as described above. For convenience, however, the more specific descriptions of the invention hereinafter set forth will be by use of dye developer diffusion transfer color processes and of integral negative-positive film units of the type contemplated in previously mentioned patents. Thus, details relating to integral negative-positive film units of the first type described hereinbefore can be found in such patents as U.S. Pat. Nos. 3,415,644 and 3,647,437 while details of the second type are found in U.S. Pat. No. 3,594,165. It will be readily apparent from such descriptions that other image-forming reagents may be used, e.g., color couplers, coupling dyes, or compounds which release a diffusible dye or dye intermediate as a result of coupling or oxidation.

Figure 1:
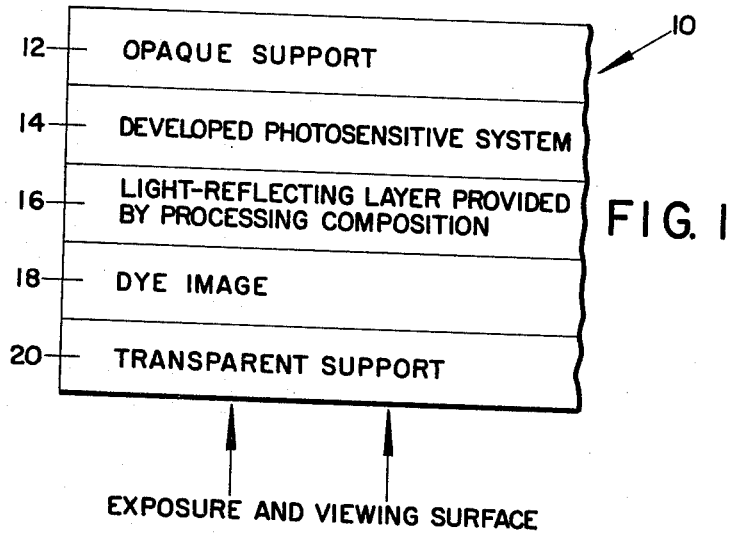
FIG. 1 is a simplified or schematic view of an arrangement of essential elements of a preferred film unit of the present invention, shown after exposure and processing.

Referring now to the drawing, FIG. 1 shows a film unit of the type described in referenced U.S. Pat. Nos. 3,415,644 and 3,657,437, following exposure and processing. The film unit 10 includes a light-reflecting layer 16 comprising a light-reflecting pigment(s) and a particulate carbon pigment of this invention. Initially, the mixture of light-reflecting pigment(s) and the carbon pigment are dispersed in a processing composition retained in a rupturable container (not shown). After photoexposure of photosensitive layer(s) 14 through transparent support 20 and image-receiving layer 18, the processing composition is distributed between layers 14 and 18. Processing compositions used in such film units of the present invention are aqueous alkaline photographic processing compositions comprising a blend or mixture of a reflecting pigment, usually titanium dioxide, and a carbon pigment of this invention; the processing composition may also comprise an optical filter agent described in detail in U.S. Pat. No. 3,647,437.

When the processing composition is distributed over photoexposed portions of photosensitive system 14, a light-reflecting layer 16 comprising the mixture of the light-reflecting pigment and a carbon pigment of this invention is provided between image-receiving layer 18 and photosensitive layer 14. This layer, at least during processing, presents sufficient opacity to protect the photosensitive system of layer 14 from further photoexposure through transparent support 20. As reflective layer 16 is installed, by application of the processing composition, development of photoexposed photosensitive layer(s) 14 is initiated to establish in manners well known in the art an imagewise distribution of diffusible image-providing material which can comprise soluble silver complex or one or more dye or dye intermediate image-providing materials. The diffusible image-providing material is transferred through permeable, light-reflecting layer 16 where it is mordanted, precipitated or otherwise retained in known manner in or on image-receiving layer 18 where the transfer image is viewed through transparent support 20 against light-reflecting layer 16.

The light-reflecting layer 16 provided by the embodiment of the invention shown in FIG. 1 is formed by solidification of the stratum of processing composition distributed after exposure. The processing composition will include the film-forming polymer which provides the polymeric binder matrix for the light-reflecting and light-absorbing carbon-based pigment mixture of layer 16. Absorption of water from the applied layer of processing composition results in a solidified film comprising the polymeric binder matrix and the mixture of pigment materials herein, thus, providing the light-reflecting layer 16 which permits the viewing thereagainst of image 18 through transparent support 20. In addition, light-reflecting layer 16 serves to laminate together the developed photosensitive system 14 and the image-bearing layer 18 to provide the final photographic laminate.

In accordance with a preferred embodiment of the invention, a photographic film unit will comprise a temporary laminate including the several layers of the photographic film unit confined between two dimensionally stable supports and having the bond between a predetermined pair of layers being weaker than the bond between other pairs of layers. Thus, with reference to FIG. 1, image-viewing layer 18 can be temporarily bonded to the silver halide emulsion layer 14 prior to exposure. The rupturable container or pod (not shown) can then be positioned such that, upon its rupture, the processing composition will delaminate the temporary bond and be distributed between the aforesaid layers 14 and 18. The distributed layer of processing composition upon drying forms light-reflecting layer 16 which serves to bond the layers together to form the desired permanent laminate. Procedures for forming such prelaminated film units, i.e., film units in which the several elements are temporarily laminated together prior to exposure, are described, for example, in U.S. Pat. No. 3,625,281 issued to Albert J. Bachelder and Frederick J. Binda and in U.S. Pat. No. 3,652,282 to Edwin H. Land, both issued Mar. 28, 1972. A particularly useful and preferred prelimination utilizes a water-soluble polyethylene glycol as described and claimed in U.S. Pat. No. 3,793,023, issued Feb. 19, 1974 to E. H. Land.

If desired, the film unit shown in FIG. 1 may utilize a transparent support instead of the opaque support 12 shown therein. In accordance with this alternative embodiment, an opaque layer, e.g., pressure-sensitive, should be superposed over said transparent support to avoid further exposure through the back of the film unit during processing outside of the camera. In the embodiment illustrated in FIG. 1, photoexposure is effected through the image-receiving element. While this is a particularly useful and preferred embodiment, it will be understood that the image-receiving element may be initially positioned out of the exposure path and superposed upon the photosensitive element after photoexposure, in which event the processing and final image stages would be the same as in FIG. 1.

Figure 2:
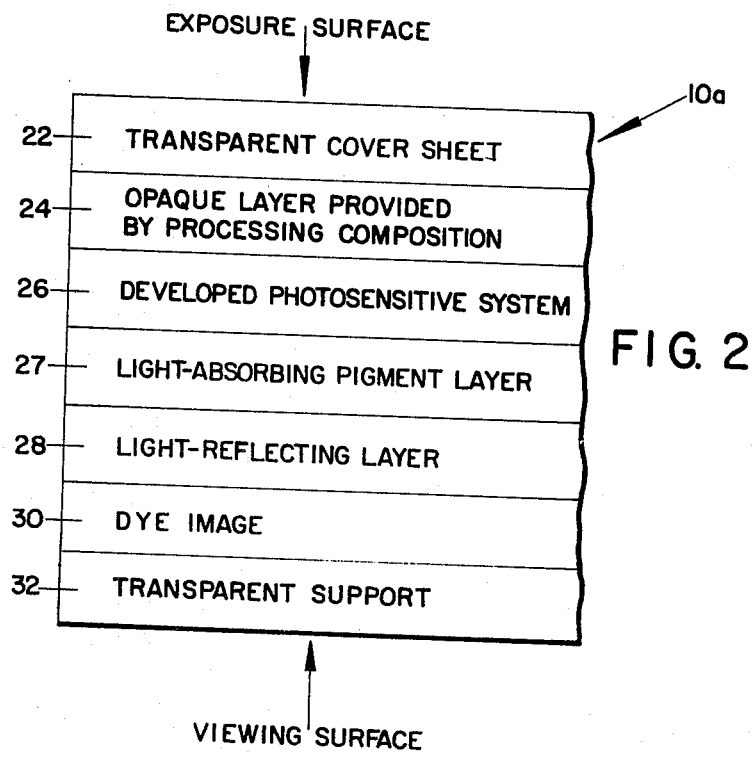
FIG. 2 is a simplified or schematic view of an arrangement of essential elements of another preferred film unit of the present invention, shown after exposure and processing.

FIG. 2 shows an arrangement of essential elements of a film unit of the types described in referenced U.S. Pat. No. 3,594,165 and British Pat. No. 1,330,524 following exposure and processing. Such an arrangement provides an integral negative-positive reflection print and photoexposure and viewing are effected from opposite sides. The film unit 10a includes a processing composition initially retained in a rupturable container (not shown) arranged to distribute the processing composition between support or spreader sheet 22 and photosensitive system or layer 26, after photoexposure of photosensitive element(s) 26 through transparent support 22. Processing compositions used in such film units are aqueous, alkaline photographic processing compositions which include a light-absorbing opacifying agent, e.g., carbon black.

After distribution of the processing composition between transparent support 22 and photoexposed photosensitive layer 26, an opaque layer 24 is installed which protects layer 26 from further photoexposure through support 22. Like the film units of FIG. 1, as and after opaque layer 24 is installed, the processing composition initiates development of photoexposed photosensitive layer 26 to establish an imagewise distribution of diffusible image-providing materials in manners well known to the art. For example, the processing composition alone may cause development or developing agents may be in the film unit so that they may be carried to layer 26 by the processing composition. The diffusible imagewise distribution is transferred to image-receiving layer 30 through permeable reflecting layer 28 which comprises a mixture of light-reflecting pigment(s) and a carbon pigment of this invention. Film units of the type shown in FIG. 2 may also comprise a preformed opaque layer 27, e.g., a dispersion of carbon black in a polymer permeable to the processing composition, between a preformed light-reflecting layer of the invention 28 and the silver halide emulsion layer or system 26. The transfer image is viewed through transparent support 32 against light-reflecting layer 28.

The films units illustrated in FIGS. 1 and 2 have, for convenience, been shown as monochrome films. Multicolor images may be obtained by providing the requisite number of differentially exposable silver halide emulsions, and said silver halide emulsions are most commonly provided as individual layers coated in superposed relationship. Film units intended to provide multicolor images comprise two or more selectively sensitized silver halide layers each having associated therewith an appropriate image dye-providing material providing an image dye having spectral absorption characteristics substantially complementary to the light by which the associated silver halide is exposed. The most commonly employed negative components for forming multicolor images are of the "tripack" structure and contain blue-, green-, and red-sensitive silver halide layers each having associated therewith in the same or in a contiguous layer a yellow, a magenta and a cyan image dye-providing material, respectively. Interlayers or spacer layers may, if desired, be provided between the respective silver halide layers and associated image dye-providing materials or between other layers. Integral multicolor photosensitive elements of this general type are disclosed in U.S. Pat. No. 3,345,163 issued Oct. 3, 1967 to Edwin H. Land and Howard G. Rogers as well as in the previously noted U.S. Patents, e.g., in FIG. 9 of the of the aforementioned U.S. Pat. No. 2,983,606.

The image dye-providing materials which may be employed in such processes generally may be characterized as either (1) initially soluble or diffusible in the processing composition but are selectively rendered non-diffusible in an imagewise pattern as a function of development; or (2) initially insoluble or non-diffusible in the processing composition but which are selectively rendered diffusible or provide a diffusible product in an imagewise pattern as a function of development. These materials may be complete dyes or dye intermediates, e.g., color couplers. The requisite differential in mobility or solubility may, for example, be obtained by a chemical action such as a redox reaction or a coupling reaction.

As examples of initially soluble or diffusible materials and their application in color diffusion transfer, mention may be made of those disclosed, for example in U.S. Pat. Nos. 2,774,668; 2,968,554; 2,983,606; 2,087,817; 3,185,567; 3,230,082; 3,345,163; and 3,443,943. As examples of initially non-diffusible materials and their use in color transfer systems, mention may be made of the materials and systems disclosed in U.S. Pat. Nos. 3,185,567; 3,443,939; 3,443,940; 3,227,550; and 3,227,552. Both types of image dye-providing substances and film units useful therewith also are discussed in the aforementioned U.S. Pat. No. 3,647,437 to which reference may be made.

Particularly desirable light-reflecting agents suited for employment as the aforesaid first light-reflecting pigment material will be those providing a white background for viewing the transfer image and which possess the optical properties desired for reflection of incident radiation. While titanium dioxide is preferred, other suitable materials are known and include barium sulfate, zinc oxide, alumina, zirconium oxide or the like, as described, for example, in aforesaid U.S. Pat. No. 3,647,437.

As mentioned, the novel light-reflcting layers of the photographic products and processes of this invention comprise a mixture or blend of a light-reflecting pigment(s) and a carbon pigment having reduced or adjusted light absorption characteristics. The preferred light-reflecting layers comprise titanium dioxide as the light-reflecting pigment and a carbon black pigment having the described and modified light-absorbing characteristics. As already mentioned, carbon blacks are actually highly efficient light-absorbing materials and have been used in integral negative-positive film units in the manners described before. However, unlike the carbon blacks of the discussed, referenced patents, the carbon black pigments involved in this invention are not black in color but instead, are grey to a dull or near white. This change in color is achieved by associating light-reflecting materials with at least a portion of the surface area of the particulate carbon to provide a pigment having reduced or adjusted light-absorbing characteristics and some measure of light-reflecting characteristics. Accordingly, the preferred light-reflecting layers of this invention comprise a mixture or blend of titanium dioxide and a carbon black pigment having light-reflecting compounds associated with the surface of the pigment particle.

As pointed out previously, light-reflecting layers comprising the blend or mixture of light-reflecting pigment(s) and carbon-based pigment of the invention provide special advantages. Thus, the layers provide effective opacification to protect and mask photoexposed photosensitive elements, and at the same time, exhibit the light-reflecting properties suited for viewing of a transfer image thereagainst. The mechanism by which the carbon-based pigment of the invention operates to provide absorption or opacification functionality, considering that the pigment is associated or effectively coated with light-reflecting material to ameliorate or otherwise mitigate the contribution of characteristic carbon blackness, is not entirely understood. While applicants do not wish to be bound by any precise theory or mechanism in explanation thereof, it is believed that the light-reflecting material associated with the surface area of the particulate carbon, in addition to providing reflection for reduction of characteristic blackness, allows incident light to be in part transmitted therethrough and absorbed by the core particles of carbon. Absorption by the carbon-based pigment particles of light which is in part reflected from other such particles in proximity thereto may also be involved.

Commercially available carbon pigments such as channel blacks, furnace blacks, bone blacks, lamp blacks, thermal blacks, charcoals, activated charcoals and activated carbon blacks can be used in the practice of this invention. Particularly suitable are carbon pigments having low average particle diameters e.g., below about 100 millimicrons. "Low average particle diameter" means the arithmetic mean particle diameter and that the major portion of the particles have diameters of about the dimension recited, although smaller portions of particles having diameters of smaller or greater dimensions can be present. Another desirable property of particularly suitable carbon pigments relates to the surface characteristics of the pigment. Carbon pigments having chemical and/or physical surface characteristics that favor intimate and relatively permanent association between the light-reflecting compound and carbon pigment surface are particularly preferred. For example, carbon pigments having surface characteristics such as high surface area and/or high surface porosity or the presence of chemical groups on the surface can provide efficient binding or association of the light-reflecting compound to or with the carbon pigment particle.

Broadly, light-reflecting compounds that can be associated with the carbon pigments of this invention include any light-reflecting compound which is substantially insoluble and stable in aqueous alkaline photographic processing compositions. "Stable in aqueous alkaline processing compositions", means that the light-reflecting compound will not decompose to or otherwise be converted to a non-light-reflecting compound in the presence of the processing composition. Particularly preferred light-reflecting compounds are light-reflecting, alkaline stable and alkaline insoluble metal salts and metal oxides such as the salts and oxides of barium, magnesium, titanium, zirconium, zinc and the like.

There are many ways by which the light-reflecting compound can be associated with the carbon pigment to provide a carbon pigment product having adjusted or reduced light-absorbing characteristics. With some carbon pigments, for example, a degree of adjustment or reduction in light-absorption characteristics may be obtained by physically mixing a light-reflecting material, reduced to as small a size as possible under conditions of high shear. Alternatively, a degree of adjustment of light-absorbing characteristics may be obtained by mixing the carbon pigment with a solution of the light-reflecting compound (preferably under high shear) and spray drying the mixture.

The carbon pigments of this invention having the preferred degree of adjustment or reduction in light-absorbing characteristics, however, are those produced by a method in which the light-reflecting compound is formed in the presence of the carbon pigment. This method essentially involves mixing a precursor of a light-reflecting compound, e.g., a light-reflecting salt or oxide with the carbon, and then converting the associated precursor to a light-reflecting salt or oxide.

A suitable illustrative method for effectively associating a light-reflecting salt with a carbon pigment involves mixing a solution of barium chloride (the precursor) with a carbon pigment under conditions of high shear e.g., ball-milling. The product produced by this mixing is a carbon pigment particle having barium chloride intimately associated with substantially all of the surface area of the carbon pigment and the product does not exhibit significantly reduced light-absorption characteristics. However, the product can be recovered, as by centrifugal separation, and reacted with another compound such as a solution of sodium sulfate to provide a product having a light-reflecting salt (barium sulfate) intimately associated with the carbon pigment particle. This product is not a black pigment particle but instead is a grey to a dull-white pigment particle depending upon the amount of light-reflecting salt associated with the carbon pigment particle.

An illustrative method for associating a light-reflecting metal oxide with carbon pigment particles can involve mixing a solution of titanium tetrachloride with a carbon pigment under conditions of high shear. Then the titanium tetrachloride associated with the carbon pigment particle can be converted to light-reflecting oxides of titanium.

The amount of carbon pigment having adjusted light-absorbing characteristics used in preparing light-reflecting layers of this invention will vary depending on certain factors. The primary factor is the optical transmission density required of the reflecting layer of a film unit to prevent fogging of photosensitive layers during processing. For example, it has been previously found by positioning neutral density (carbon containing) filters over a layer of titanium dioxide, that a transmission density of about 6.0 from the neutral density filters is effective to prevent fogging of a film unit of the type described in U.S. Pat. No. 3,415,644 having a transparent support layer and an Equivalent ASA Exposure Index of about 75 when processed for 1 minute in 10,000 foot candles of light color-corrected for sunlight. Accordingly, the amount of carbon-based pigment of this invention used in combination with the light-reflecting pigment must be at least sufficient to provide a light-relecting layer having an optical transmission density effective to prevent fogging of the photosensitive layers under the intended conditions of use. In most diffusion transfer products and processes, this requisite optical transmission density will be at least about 6.0 and generally about 7.0 or somewhat higher.

It should be understood, however, that reflecting layers comprising light-reflecting pigments and the carbon-based pigments of this invention can also include other auxiliary opacification systems or agents which can cooperate, preferably additively, with carbon pigment to provide the requisite optical transmission density. In such instances, the amount of carbon-based pigment of this invention used will be at least the amount necessary, in combination with the other pigments, agents or systems present, to provide a light-reflecting layer presenting the requisite transmission density. For example, a preformed pigmented layer, e.g., coated over the image-receiving layer 18, can be utilized and photoexposure therethrough effected, in accordance with the teachings of U.S. Pat. No. 3,615,421, issued Oct. 26, 1971 to E. H. Land.

Another consideration determinative of the amount of carbon-based pigment of this invention used in preparing light-reflecting layers relates to the degree of adjustment in light-absorbing characteristics achieved by associating the light-reflecting compound with the carbon pigment particle. This degree of adjustment can vary depending on such factors as the type of carbon pigment involved, the light-reflecting compound associated with the pigment and the manner by which the association was achieved. However, carbon pigments of this invention having a particularly suitable degree of adjustment of light-absorbing characteristics are those that are grey in color. In other words, the particularly suitable grey carbon pigments have a degree of light-reflecting capacity sufficient to change the discernible color of the black pigment to grey. But at the same time, the degree of light-reflecting capacity does not significantly impair the light-absorbing characteristics of the carbon pigment so that the pigment retains an efficient light-absorbing capability. Although the degree of adjustment in light-absorption characteristics can affect the amount of carbon pigment of this invention used, light-reflecting layers containing a mixture of the grey carbon pigments and light-reflecting pigments can usually provide the requisite transmission density when the grey carbon pigment represents at least about 3% of the combined weight of grey carbon pigment and light-reflecting pigment. These grey carbon pigments provide suitable light-reflecting layers for diffusion transfer photographic products and processes. As will be illustrated later, light-reflecting layers comprising the grey carbon pigments of this invention provide layers having the requisite transmission density coupled with significantly increased light-reflecting efficiencies as compared to reflecting layers using equivalent weights of the same carbon which does not have adjusted light-absorption characteristics.

A light-reflecting layer comprising the polymeric binder matrix and first and second pigment materials as hereinbefore defined can be readily integrated into a diffusion transfer film unit. Thus, in the case of an integral negative-positive film unit of the type illustrated in FIG. 2, a preformed layer 28 comprising a polymeric binder matrix material and the first light-reflecting pigment material and second light-absorbing carbon-based pigment material can be suitably embodied into the film unit by resort to known coating methods. Suitable polymeric binder matrix materials are polymeric high-molecular weight materials substantially inert and permeable to aqueous alkaline processing compositions and inclusive of such film-forming materials as hydroxyethyl cellulose or sodium carboxymethyl cellulose. In the case of integral negative-positive film units of the type illustrated in FIG. 1, the light-reflecting layer 16 can be readily integrated into the film unit by including the polymeric film-forming material and the respective light-reflecting and light-absorbing carbon-based pigment materials in the processing composition in appropriate amounts having in mind the factors hereinbefore described. Upon drying, the light-reflecting layer for viewing of the photographic image is conveniently provided and serves additionally to provide desired permanent lamination of the film structure.

The processing compositions employed in diffusion transfer processes of the type contemplated herein will generally comprise aqueous alkaline compositions having a pH in excess of about 12, and frequently in the order of 14 or greater. The liquid processing composition permeates the emulsion layer(s) of the photosensitive element to effect development thereof. The liquid processing compositions utilized in the diffusion transfer processes herein comprise at least an aqueous solution of an alkaline material, for example, sodium hydroxide, potassium hydroxide or the like. The composition can include known silver halide developing agents as auxiliary developers or such materials can suitably be included in the photosensitive element in known manner. The processing composition will include a film-forming material of the type hereinbefore described which, when the composition is spread and dried, forms the relatively firm and relatively stable binder matrix material of the light-reflecting layer 16.

The film-forming material is preferably contained in the processing composition in such suitable quantities as to impart to the composition a viscosity in excess of 100 cps. at a temperature of approximately 24° C., and preferably, in the order of 40,000 cps. to 100,000 cps. at that temperature. Examples of suitable processing compositions to which the pigment materials of the light-reflecting layers hereof can be added can be found in the aforesaid U.S. Pat. Nos. 2,983,606 and 3,415,644. As has set forth herein, the aqueous alkaline processing composition will preferably be included in a rupturable or frangible container. Examples of suitable rupturable containers and their methods of manufacture can be found, for example, in U.S. Pat. Nos. 2,543,181; 2,634,886; 3,653,732; 3,056,491 and 3,152,515.

In the various color diffusion transfer systems which have previously been described, and which employ an aqueous alkaline processing fluid, it is well known to employ an acid-reacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. No. 3,415,644 discloses systems wherein the desired pH reduction may be effected by providing a polymeric acid layer adjacent the dyeable stratum. These polymeric acids may be polymers which contain acid groups, which are capable of forming salts with alkali metals or with organic bases; or potentially acid-yielding groups such as anhydrides or lactones. Preferably the acid polymer contains free carboxyl groups. Alternatively, or in addition, an acid-reacting reagent may be provided in a layer adjacent to the silver halide layer most distant from the image-receiving layer, as disclosed in U.S. Pat. No. 3,573,043 issued Mar. 30, 1971 to Edwin H. Land. Another system for providing an acid-reacting reagent is disclosed in U.S. Pat. No. 3,576,625 issued Apr. 27, 1971 to Edwin H. Land.

An inert interlayer or spacer layer may be and is preferably disposed between the polymeric acid layer and the dyeable stratum in order to control or "time" the pH reduction so that it is not premature and thus interfere with the development process. Suitable spacer or "timing" layers for this purpose are described with particularity in U.S. Pat. Nos. 3,362,819; 3,419,389; 3,421,893; 3,455,686 and 3,575,701.

The invention and manners of making it and using will be better appreciated by reference to the following Examples illustrating preferred embodiments of the invention.

EXAMPLE 1

This Example illustrates a preferred method for preparing a suitable carbon pigment of this invention.

A slurry of one gram of a furnace carbon black (Sterling NS.; Cabot Corporation) was placed in a ball mill and a solution containing 30 grams of barium chloride in distilled water was added. The carbon black slurry and barium chloride solution was ball-milled for 72 hours and the product was collected using a centrifuge. The collected product was then placed in a blender as a slurry in distilled water. Then, while blending, a solution containing 40 grams sodium sulfate in distilled water was added slowly. After addition of the sodium sulfate solution, the mixture was blended for 15 minutes. Then, the product was collected by centrifuge, washed three times and dried. The resulting product was a light grey pigment and approximately 20 grams of dry product were recovered—meaning that approximately 19 grams of barium sulfate were associated with the original 1 gram of carbon black or that the percent by weight of carbon in the pigment product was about 5%.

In order to illustrate the advantages obtained by using light-reflecting layers of this invention, a series of film units of the type shown in FIG. 1 were prepared. These film units were prepared by coating a gelatin subbed 4 mil. opaque polyethylene terephthalate film base, with the following layers;

1. a layer of cyan dye developer dispersed in gelatin and coated at a coverage of about 65 mgs./ft.$^2$ of dye and about 65 mgs./ft.$^2$ of gelatin;

2. a red-sensitive gelatino silver iodobromide emulsion coated at a coverage of about 98 mgs./ft.$^2$ of silver and about 98 mgs./ft.$^2$ of gelatin;

3. a layer of a 60-30-4-6 tetrapolymer of butylacrylate, diacetone acrylamide, styrene and methacrylic acid and polyacrylamide coated at a coverage of about 311 mgs./ft.$^2$ of the tetrapolymer and about 8 mgs./ft.$^2$ of polyacylamide;

4. a layer of magenta dye developer dispersed in gelatin and coated at a coverage of about 69 mgs./ft.$^2$ of dye and about 69 mgs./ft.$^2$ of gelatin;

5. a green-sensitive gelatino silver iodobromide emulsion coated at a coverage of about 58 mgs./ft.$^2$ of silver and about 58 mgs./ft.$^2$ of gelatin;

6. a layer containing the tetrapolymer referred to above in layer 3 and polyacrylamide coated at a coverage of about 107 mgs./ft.$^2$ of tetrapolymer and about 2.6 mgs./ft.$^2$ of polyacrylamide;

7. a layer of yellow dye developer dispersed in gelatin and coated at a coverage of about 84 mgs./ft.$^2$ of dye and about 84 mgs./ft.$^2$ of gelatin;

8. a blue-sensitive gelatino silver iodobromide emulsion layer including the auxiliary developer 4'-methylphenyl hydroquinone coated at a coverage of about 92 mgs./ft.$^2$ of silver, about 92 mgs./ft.$^2$ of gelatin and about 20 mgs./ft.$^2$ of auxiliary developer; and 9. a layer of gelatin coated at a coverage of about 40 mgs./ft.$^2$ of gelatin.

The three dye developers employed above were the following:

cyan:

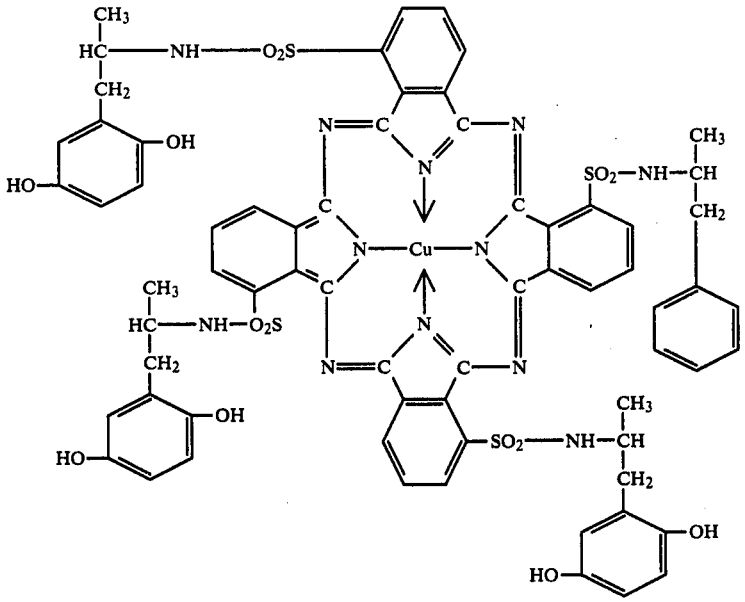

magenta:

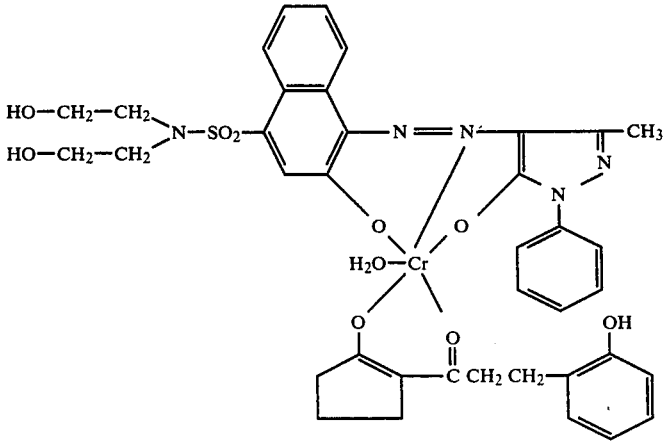

yellow:

-continued

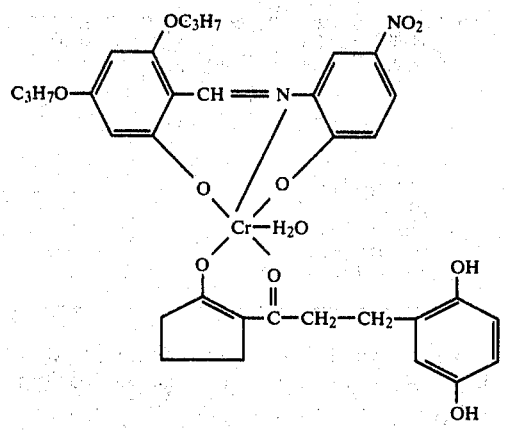

A transparent 4 mil. polyester film base containing a small quantity of a finely divided carbon black dispersed therein to control light-piping (as described in British Pat. No. 1,381,107) was coated in succession, with the following layers:

1. a partial butyl ester of polyethylene/maleic anhydride copolymer at a coverage of about 2,450 mgs./ft.$^2$ of polymer to provide a neutralizing layer.

2. an interpolymer having a weight ratio of 80/10/3.5/4.5/2.0 of butylacrylate/hydroxypropyl methacrylic acid/acrylic acid/styrene/ethylene glycol dimethacrylate at a coverage of about 100 mgs./ft.$^2$, to provide a polymeric spacer or timing layer; and 3. a graft copolymer having 4-vinyl pyridine and vinylbenzyl trimethylammonium chloride grafted to a hydroxyethyl cellulose backbone where the weight ratio of hydroxyethyl cellulose to 4-vinyl pyridine to vinylbenzyl trimethylammonium chloride is 2.2/2.2/1 at a coverage of about 300 mgs./ft.$^2$ to provide a polymeric image-receiving layer.

After photoexposure as described below, the two components were taped together at one end with a rupturable container retaining an aqueous alkaline processing composition so mounted that pressure applied to the container could rupture the container's marginal seal and distribute the processing composition between the image-receiving layer and the gelatin overcoat layer of the photosensitive component.

Except for variations described in the Example, the aqueous alkaline processing composition comprised:

| | |
|---|---|
| Water | 1782. g |
| Potassium Hydroxide (45%) | 310. g |
| Benzyl-α-Picolinium Bromide (50% Solution in Water) | 90. g |
| Carboxymethyl-Hydroxyethyl Cellulose | 60. g |
| Titanium Dioxide Pigment | 1200. g |
| Benzotriazole | 28. g |
| $Zn(NO_3)_2 \cdot 6H_2O$ | 14. g |
| 2,5-Dimethyl Pyrazole | 6. g |
| 5-methyl-6-bromo-4-azabenzimidazole | .6 g |

EXAMPLE 2

This Example presents a comparison of a series of film units prepared as described before. The pigment composition of the light-reflecting layer of film units LG-1, LG-2 and LG-3 of Table 1 below was varied as described here and in Table 1. The variation in pigment composition was achieved by adding an opacifying pigment to the titanium dioxide pigment containing processing composition described before. However, the processing composition used in film unit LG-1 was the processing composition described before without any additional opacifying pigment. Accordingly, film unit LG-1 had a light-reflecting layer which contained only titanium dioxide as the pigment material of the layer. The light-reflecting layer was produced, as it was in all film units of Table 1, by distributing the pigment containing processing composition in a layer of approximately 0.003 inch between the image-receiving layer and the gelatin top coat layer after photoexposure.

The pigment containing processing composition used in LG-2 was also the titanium dioxide pigment containing processing composition described before but additionally contained a commercially available furnace carbon black (Sterling NS.) as an auxiliary opacifying agent. The amount of furnace carbon black added to the processing composition was equivalent to about 1.3% by weight of the total weight of the processing composition to which the carbon was added. This amount of carbon black in combination with the titanium dioxide was sufficient to provide, on distribution, a reflecting layer substantially opaque to a 10,000 foot-candle exposure.

The reflecting layer of film unit LG-3 had a pigment composition consisting of titanium dioxide and the carbon pigment product of Example 1 as an auxiliary opacifying agent. The amount of carbon pigment product of Example 1 added to the processing composition described before was enough—based on the % by weight of carbon in the product—to provide an amount of carbon substantially equivalent to that used in the reflecting layer of film unit LG-2.

The film units (LG-1, LG-2, LG-3) were photoexposed under identical conditions and processed by distributing the processing composition of each film unit as already described. Immediately after distribution of the processing composition, film units LG-1, LG-2 an LG-3 were exposed to a 10,000 foot-candle exposure for 30 seconds.

After processing was complete, it was found that the light-reflecting layer of film unit LG-1 did not provide sufficient opacity to prevent fogging of the film unit during the 30 second 10,000 foot-candle exposure. However, the light-reflecting layers of film units LG-2 and LG-3 did provide sufficient opacity to prevent any discernible fogging during the 30 second exposure at 10,000 foot-candles. This was confirmed by comparing D max values of film units LG-2 and LG-3 with D max values of controls for each film unit which were processed in a dark chamber and not subject to the 10,000 foot-candle exposure. D-min measurements were also made on film units LG-2 and LG-3. Table 1 below summarizes the data obtained:

TABLE 1

| Film Unit | Pigment Compostion of Reflecting Layer | Opacification of Reflecting Layer at 10,000 Foot-Candles Sufficient or Insufficient | D-min. (Red D-min value) |
|---|---|---|---|
| LG-1 | Titanium dioxide | Insufficient | |
| LG-2 | Titanium dioxide and carbon black (Sterling NS) | Sufficient | 0.63 |
| LG-3 | Titanium dioxide and carbon pigment product of Example 1. | Sufficient | 0.48 |

This Example illustrates some of the interesting advantages to be obtained by using the reflecting layers of this invention. Note that the reflecting layer of film unit LG-1 does not provide sufficient opacification to prevent additional photoexposure (fogging) of the film unit at the 10,000 foot-candle exposure level. However, the reflecting layers of film units LG-2 and LG-3 (containing the auxiliary opacification agents) do provide the requisite opacity at this exposure level. But even though the reflecting layers of film units LG-2 and LG-3 contain substantially the same amount of carbon, there are significant differences between the Red D-min values obtained. A Red D-min value is the minimum density value recorded for red light by a densitometer. D-min values are sometimes referred to as "white area values" because they pertain to areas of minimum or substantially no dye transfer. Accordingly, in the integral negative-positive film units of this Example, Red D-min values represent a relative measure of the "whiteness" or reflection efficiency of the background provided by the light-reflecting layer. And, the lower the D-min the greater the light reflection efficiency of the reflecting layer. According to this interpretation, the light-reflecting efficiency of the reflecting layer of film unit LG-3 is significantly better than the light-reflecting efficiency of the reflecting layer of LG-2 even though both layers contain substantially the same amount of carbon.

EXAMPLE 3

This example presents a comparison of two film units having reflecting layers opaque to a 10,000 foot-candle exposure but having different pigment compositions. Film unit LG-4 of Table 2 had a light-reflecting layer consisting of titanium dioxide pigment and a commercially available furnace carbon black (Sterling NS). The amount of carbon black was equivalent to about 2.0% by weight carbon of the total weight of the processing composition to which the carbon was added. Film unit LG-5 had a light-reflecting layer consisting of titanium dioxide pigment and the carbon pigment product of Example 1. The amount of carbon pigment product of Example 1 was enough—based on the weight of carbon in the pigment product—to provide an amount of carbon equivalent to that used in film unit LG-4. Exposure, processing and measurements were made as in Example 2. Table 2 summarizes the data obtained:

TABLE 2

| Film Unit | Pigment Composition of Reflecting Layer | Opacficiation of Reflecting Layer at 10,000 Foot-Candles (Sufficient or Insufficient | D-min. (Red D-min value) |
|---|---|---|---|
| LG-4 | Titanium dioxide and carbon black (Sterling NS) | Sufficient | 0.77 |
| LG-5 | Titanium dioxide and and carbon pigment product of Example 1. | Sufficient | 0.48 |

As can be seen from Table 2, the reflecting layers of film units LG-4 and LG-5 provide sufficient opacity to prevent fogging of the film unit during processing. This of course would be expected because the amount of carbon in each layer was an amount equivalent to about 2% by weight of the processing composition. As evidenced by Table 1 (film unit LG-2) an amount of carbon equivalent to about 1.3% is sufficient to provide a layer of the requisite opacity. But there are interesting comparisons to be made between the D-min values of the film units of Table 2 and film units LG-2 and LG-3 of Table 1. For example, a comparison of the D-min values of film unit LG-2 (Table 1) and film unit LG-4 (Table 2) shows that the D-min value has increased as the concentration of carbon black in the reflecting layer is increased. In other words the background provided by the reflecting layer becomes darker as the concentration of carbon black in the layer is increased. This is not the case with respect to the reflecting layers of film unit LG-3 (Table 1) and film unit LG-5 (Table 2) which comprises the carbon pigment product of Example 1. The D-min values of these film units are the same (0.48) despite the fact that the concentration of carbon—as carbon—in each reflecting layer is markedly different.

EXAMPLE 4

This Example presents a comparison between film units prepared, processed and evaluated in the manner of Examples 1 to 3, except that: in the case of film unit LG-6 the amount of carbon black (Sterling NS) utilized in the processing composition was about 0.8% of the total weight of the processing composition to which the carbon was added; and in the case of LG-7, the carbon-based pigment product of Example 1 was utilized in an amount, based on the weight of the carbon in the pigment product, to provide an amount of carbon equivalent to that used in film unit LG-6. Table 3 summarizes the data obtained from evaluation of film units LG-6 and LG-7.

TABLE 3

| Film Unit | Pigment Composition of Reflecting Layer | Opacification of Reflecting Layer at 10,000 Foot-Candles-Sufficient or Insufficient | D-min. (Red D-min value |
|---|---|---|---|
| LG-6 | Titanium Dioxide and Carbon Black (Sterling NS) | Insufficient | |
| LG-7 | Titanium Dioxide and Carbon Pigment Product of Example 1 | Sufficient | 0.44 |

From the results reported in Table 3, it can be seen that the light-reflecting layer of film unit LG-6 did not provide sufficient opacity to prevent fogging of the film unit during the 30 second 10,000 foot-candle exposure. However, the light-reflecting layer of film unit LG-7 provided sufficient opacification to prevent discernible fogging during the 30 second exposure at 10,000 candle meter seconds. This was confirmed by comparing the D-max value of film unit LG-7 with the D-max value of a control for such film unit processed in a dark chamber and not subject to the 10,000 candle meter second exposure. As indicated previously, the provision from film unit LG-7 of a light-reflecting layer affording sufficient opacification, compared with insufficient protection from film unit LG-6 having an equivalent weight of carbon, may be the result of absorption by the carbon-based pigment material of Example 1 of light in part reflected from other such particles in close proximity thereto in the light-reflecting layer.

What is claimed is:

1. A photographic product for forming a diffusion transfer image within a permanent laminate including at least one developed silver halide layer, the photographic product comprising, in combination: an image-receiving layer; at least one photosensitive silver halide emulsion layer, each said silver halide emulsion having associated therewith an image-forming material; means for providing a light-reflecting layer positioned between the silver halide layer or layers and the image-receiving layer and effective to mask the developed silver halide layer or layers and to provide a white background for viewing a transfer image in the image-receiving layer, the light-reflecting layer consisting essentially of a polymeric binder matrix having uniformly distributed therethrough a first light-reflecting pigment material and a second light-absorbing carbon-based pigment material consisting of particulate carbon coated with a light-reflecting material on substantially all of the surface area of the carbon particles; a transparent support through which the transfer image may be viewed against the light-reflecting layer; and means for providing a processing composition for developing the silver halide emulsion or emulsions after photoexposure and for forming a transfer image in said image-receiving layer.

2. A photographic product as defined in claim 1 wherein said means for providing said light-reflecting layer comprises providing said polymeric binder matrix and said first and second pigment materials in said processing composition, and said processing composition is contained in a rupturable container positioned to distribute said processing composition containing said polymeric binder matrix and said first and second pigment materials between said image-receiving layer and said silver halide emulsion layer or layers.

3. A photographic product as defined in claim 1 wherein said photosensitive silver halide emulsion layer(s) are adapted to be exposed through said transparent support.

4. A photographic product as defined in claim 1 comprising a temporary laminate including said layers confined between two dimensionally stable supports, at least one of said supports being said transparent support, the bond between a predetermined pair of layers being weaker than the bond between other pairs of layers, and including a rupturable container releasably holding said processing composition, said processing composition containing said polymeric binder matrix and said first and second pigment materials, said rupturable container being so positioned as to distribute said processing composition between said predetermined layers, said processing composition being adapted to provide said permanent laminate following distribution and drying.

5. A photographic product as defined in claim 1 wherein said second light-absorbing carbon-based pigment consists of particulate carbon having a mean diameter of below about 100 millimicrons having a light-reflecting material coated on substantially all of the surface area of said particulate carbon.

6. A photographic product as defined in claim 1 wherein said second light-absorbing carbon-based pigment consists of particulate carbon having substantially all of the surface area thereof coated with an alkali-stable and alkali-insoluble light-reflecting metal oxide or salt.

7. A photographic product as defined in claim 6 wherein said alkali-stable and alkali-insoluble light-reflecting metal salt comprises barium sulfate.

8. A photographic product as defined in claim 6 wherein said particulate carbon having substantially all of the surface area thereof coated with said alkali-stable and alkali-insoluble light-reflecting metal oxide or salt is the result of coating substantially all of the surface area of said particulate carbon with a precursor of said light-reflecting metal oxide or salt and, thereafter, converting said precursor to said light-reflecting metal oxide or salt.

9. The photographic product as defined in claim 8 wherein said particulate carbon having substantially all of the surface area thereof coated with said alkali-stable and alkali-insoluble light-reflecting metal oxide or salt is the result of coating substantially all of the surface area of said particulate carbon under conditions of high shear with a solution of barium chloride, thereby to provide a precursor of light-reflecting pigment coated on substantially all of the surface area thereof; and, thereafter, converting said precursor to barium sulfate by reaction with a solution of sodium sulfate, thereby to provide a pigment material consisting of particulate carbon having light-reflecting barium sulfate coated on substantially all of the surface area thereof.

10. A photographic product as defined in claim 1 wherein said first light-reflecting pigment material comprises the major portion of said mixture of pigment materials uniformly distributed throughout said polymeric binder matrix and said second light-absorbing carbon-based pigment material is distributed throughout said polymeric binder matrix in an amount sufficient in combination with said first pigment material, to provide said light-reflecting layer with an optical transmission density effective to prevent fogging of said photosensitive layer or layers.

11. A photographic product as defined in claim 10 wherein said first light-reflecting pigment comprises titanium dioxide and said second light-absorbing carbon-based pigment material consists of particulate carbon having substantially all of the surface area thereof coated with an alkali-stable and alkali-insoluble light reflecting metal oxide or salt.

12. A photographic product as defined in claim 11 wherein said second light-absorbing carbon-based pigment is employed in said light-reflecting layer in an amount by weight, based upon the combined weight of said first and second pigment materials, of at least about 3%.

13. A photographic product as defined in claim 12 wherein said second light-absorbing carbon-based pigment material consists of particulate carbon having substantially all of the surface area thereof coated with barium sulfate.

14. A photographic product for forming a diffusion transfer image within a permanent laminate which comprises: a first sheet-like element comprising an opaque support carrying at least one photosensitive silver halide emulsion layer, each said silver halide emulsion layer having associated therewith an image-forming material; a second sheet-like element comprising a transparent support carrying an image-receiving layer; a rupturable container releasably holding an aqueous alkaline processing composition including a film-forming polymer, a first light-reflecting pigment material and a second light-absorbing carbon-based pigment material consisting of particulate carbon having a light-reflecting material coated on substantially all of the surface area of the particulate carbon; said first and second sheet-like elements being held in superposed, fixed relationship, with said supports outermost, during photoexposure and processing; said silver halide emulsion layer(s) being exposable through said transparent support; said rupturable container being positioned so as to release said processing composition for distribution between said sheet-like elements after photoexposure to provide a light-reflecting layer consisting essentially of a polymeric binder matrix of said film-forming polymer having said first and second pigment materials uniformly distributed therethrough, said light-reflecting layer providing a background against which said diffusion transfer image formed in said image-receiving layer may be viewed through said transparent support without separation of said superposed first and second sheet-like elements.

15. A photographic product as defined in claim 14 wherein said second light-absorbing carbon-based pigment consists of particulate carbon having a mean diameter of below about 100 millimicrons having a light-reflecting material coated on substantially all of the surface area of said particulate carbon.

16. A photographic product as defined in claim 14 wherein said second light-absorbing carbon-based pigment consists of particulate carbon having substantially all of the surface area thereof coated with an alkali-stable and alkali-insoluble light-reflecting metal oxide or salt.

17. A photographic product as defined in claim 16 wherein said alkali-stable and alkali-insoluble light-reflecting metal salt comprises barium sulfate.

18. A photographic product as defined in claim 16 wherein said particulate carbon having substantially all of the surface area thereof coated with said alkali-stable and alkali-insoluble light-reflecting metal oxide or salt is the result of coating substantially all of the surface area of said particulate carbon with a precursor of said light-reflecting metal oxide or salt and, thereafter, converting said precursor to said light-reflecting metal oxide or salt.

19. The photographic product as defined in claim 18 wherein said particulate carbon having substantially all of the surface area thereof coated with said alkali-stable and alkali-insoluble light-reflecting metal oxide or salt is the result of coating substantially all of the surface area of said particulate carbon under conditions of high shear with a solution of barium chloride, thereby to provide a precursor of light-reflecting pigment coated on substantially all of the surface area of said particulate carbon; recovering said particulate carbon having said precursor coated on the surface area thereof, and, thereafter, converting said precursor to barium sulfate by reaction with a solution of sodium sulfate, thereby to provide a pigment material consisting of particulate carbon having light-reflecting barium sulfate coated on substantially all of the surface area thereof.

20. A photographic product as defined in claim 14 wherein said first light-reflecting pigment comprises the major portion of said mixture of pigment materials included in said aqueous alkaline processing composition and said second light-absorbing carbon-based pigment material is included in said aqueous alkaline processing composition in an amount sufficient in combination with said first pigment material, to provide a light-reflecting layer having an optical transmission density effective to prevent fogging of said photosensitive layer or layers.

21. A photographic product as defined in claim 20 wherein said first light-reflecting pigment comprises titanium dioxide and said second light-absorbing carbon-based pigment material consists of particulate carbon having substantially all of the surface area thereof coated with an alkali-stable and alkali-insoluble light-reflecting metal oxide or salt.

22. A photographic product as defined in claim 21 wherein said second light-absorbing carbon-based pigment is employed in said aqueous alkaline processing composition in an amount by weight, based upon the combined weight of said first and second pigment materials, of at least about 3%.

23. A photographic product as defined in claim 22 wherein said second light-absorbing carbon-based pigment material consists of particulate carbon having substantially all of the surface area thereof coated with barium sulfate.

24. A photographic product for forming a diffusion transfer image within a permanent laminate which comprises: a first sheet-like element comprising a first transparent support; a second sheet-like element comprising a second transparent support carrying, in sequence, an image-receiving layer, a light-reflecting layer consisting essentially of a polymeric binder matrix having uniformly distributed therethrough a first light-reflecting pigment material and a second light-absorbing carbon-based pigment material consisting of particulate carbon having a light-reflecting material coated on substantially all of the surface area of the carbon particles, and at least one photosensitive silver halide emulsion layer, each said silver halide emulsion layer having associated therewith an image-forming material; a rupturable container releasably holding an aqueous alkaline opaque processing composition; said first and second sheet-like elements being held in superposed, fixed relationship, with said supports outermost, during photoexposure and processing, said silver halide emulsion layer(s) being exposable through said first transparent support; said rupturable container being positioned so as to release said aqueous alkaline opaque processing composition for distribution between said first and second sheet-like elements.

25. A photographic product as defined in claim 24 wherein said second light-absorbing carbon-based pigment consists of particulate carbon having a mean diameter of below about 100 millimicrons having a light-reflecting material coated on substantially all of the surface area of said particulate carbon.

26. A photographic product as defined in claim 24 wherein said second light-absorbing carbon-based pigment consists of particulate carbon having substantially all of the surface area thereof coated with an alkali-stable and alkali-insoluble light-reflecting metal oxide or salt.

27. A photographic product as defined in claim 26 wherein said alkali-stable and alkali-insoluble light-reflecting metal salt comprises barium sulfate.

28. A photographic product as defined in claim 26 wherein said particulate carbon having substantially all of the surface area thereof coated with said alkali-stable and alkali-insoluble light-reflecting metal oxide or salt is the result of coating substantially all of the surface area of said particulate carbon with a precursor of said light-reflecting metal oxide or salt and, thereafter, converting said precursor to said light-reflecting metal oxide or salt.

29. The photographic product as defined in claim 28 wherein said particulate carbon having substantially all of the surface area thereof coated with said alkali-stable and alkali-insoluble light-reflecting metal oxide or salt is the result or coating substantially all of the surface area of said particulate carbon under conditions of high shear with a solution of barium chloride, thereby to provide a precursor of light-reflecting pigment coated on substantially all of the surface area of said particulate carbon; recovering said particulate carbon having said precursor coated on the surface area thereof; and, thereafter, converting said precursor to barium sulfate by reaction with a solution of sodium sulfate, thereby to provide a pigment material consisting of particulate carbon having light-reflecting barium sulfate coated on substantially all of the surface area thereof.

30. A photographic product as defined in claim 24 wherein said first light-reflecting pigment material comprises the major portion of said mixture of pigment materials uniformly distributed throughout said polymeric binder matrix and said second light-absorbing carbon-based pigment material is distributed throughout said polymeric binder matrix in an amount sufficient in combination with said first pigment material, to provide said light-reflecting layer with an optical transmission density effective to prevent fogging of said photosensitive layer or layers.

31. A photographic product as defined in claim 30 wherein said first light-reflecting pigment comprises titanium dioxide and second light-absorbing carbon-based pigment material consists of particulate carbon having substantially all of the surface area thereof coated with barium sulfate.

32. A photographic product as defined in claim 31 wherein said second light-absorbing carbon-based pigment is employed in said light-reflecting layer in an amount by weight, based upon the combined weight of said first and second pigment materials, of at least about 3%.

33. A photographic product as defined in claim 32 wherein said second light-absorbing carbon-based pigment material consists of particulate carbon having substantially all of the surface area thereof coated with an alkali-stable and alkali-insoluble light-reflecting metal oxide or salt.

34. A photographic laminate comprising, permanently laminated together; at least one exposed and developed silver halide layer; an image-carrying layer containing an image in at least one dye; a light-reflecting layer positioned between the silver halide layer or layers and the image-receiving layer and effective to mask the developed silver halide layer of layers and provide a background for viewing a transfer image in the image-receiving layer, the light-reflecting layer consisting essentially of a polymeric binder matrix having uniformly distributed therethrough a first light-reflecting pigment material and a second light-absorbing carbon-based pigment material consisting of particulate carbon having a light-reflecting material coated on substantially all of the surface area of the carbon particles; and a transparent layer through which the image may be viewed against the light-reflecting layer.

35. A photographic laminate as defined in claim 34 wherein said second light-absorbing carbon-based pigment consists of particulate carbon having a mean diameter of below about 100 millimicrons having a light-reflecting material coated on substantially all of the area of said particulate carbon.

36. A photographic laminate as defined in claim 34 wherein said second light-absorbing carbon-based pigment consists of particulate carbon having substantially all of the surface area thereof coated with an alkali-stable and alkali-insoluble light-reflecting metal oxide or salt.

37. A photographic laminate as defined in claim 36 wherein said alkali-stable and alkali-insoluble light-reflecting metal salt comprises barium sulfate.

38. A photographic laminate as defined in claim 36 wherein said particulate carbon having substantially all of the surface area thereof coated with said alkali-stable and alkali-insoluble light-reflecting metal oxide or salt is the result of coating substantially all of the surface area of said particulate carbon with a precursor of said light-reflecting metal oxide or salt and, thereafter, converting said precursor to said light-reflecting metal oxide or salt.

39. The photographic laminate as defined in claim 38 wherein said particulate carbon having substantially all of the surface area thereof coated with said alkali-stable and alkali-insoluble light-reflecting metal oxide or salt is the result of coating substantially all of the surface area of said particulate carbon under conditions of high shear with a solution of barium chloride, thereby to provide a precursor of light-reflecting pigment coated on substantially all of the surface area of said particulate carbon; recovering said particulate carbon having said precursor coated on substantially all of the surface area thereof; and, thereafter, converting said precursor to barium sulfate by reaction with a solution of sodium sulfate, thereby to provide a pigment material consisting of particulate carbon having light-reflecting barium sulfate coated on substantially all of the surface area thereof.

40. A photographic laminate as defined in claim 34 wherein said first light-reflecting pigment comprises titanium dioxide and said second light-absorbing carbon-based pigment material consists of particulate carbon having substantially all of the surface area thereof coated with an alkali-stable and alkali-insoluble light-reflecting metal oxide or salt and is employed in said light-reflecting layer in an amount by weight, based upon the combined weight of said first and second pigment materials, of at least about 3%.

* * * * *